US006746271B2

(12) United States Patent
Simmel

(10) Patent No.: US 6,746,271 B2
(45) Date of Patent: Jun. 8, 2004

(54) ELECTRICAL PLUG CONNECTION HAVING AN ADJUSTABLE CODING

(75) Inventor: Andreas Simmel, Schwaikheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/108,673

(22) Filed: Mar. 28, 2002

(65) Prior Publication Data

US 2002/0177355 A1 Nov. 28, 2002

(30) Foreign Application Priority Data

Mar. 31, 2001 (DE) ..... 201 05 677 U

(51) Int. Cl.[7] ..... H01R 3/00
(52) U.S. Cl. ..... 439/491
(58) Field of Search ..... 439/491, 681, 439/680

(56) References Cited

U.S. PATENT DOCUMENTS 5,613,874 A * 3/1997 Orlando et al. ..... 439/491
5,620,335 A * 4/1997 Siemon ..... 439/491
5,741,153 A 4/1998 Schwer
6,283,788 B1 * 9/2001 Katwala ..... 439/491

FOREIGN PATENT DOCUMENTS

| | | |
|---|---|---|
| DE | 7343794 | 8/1974 |
| EP | 0 887 893 | 12/1998 |

* cited by examiner

*Primary Examiner*—Gary Paumen
(74) *Attorney, Agent, or Firm*—Kenyon & Kenyon

(57) ABSTRACT

Electrical plug connections, in particular cable harness plugs, have codings on their side surfaces that indicate the type or the assembly, i.e. the arrangement, of individual cables of a cable harness on the contact elements situated in a plug housing. Typically, cable harness plugs already have certain codings prior to assembly, so that different variations must be reserved for the different types of cable harness plugs. The present invention provides attaching the coding immediately after assembly and together with the final inspection of the cable harness plug or of the plug connection.

2 Claims, 1 Drawing Sheet

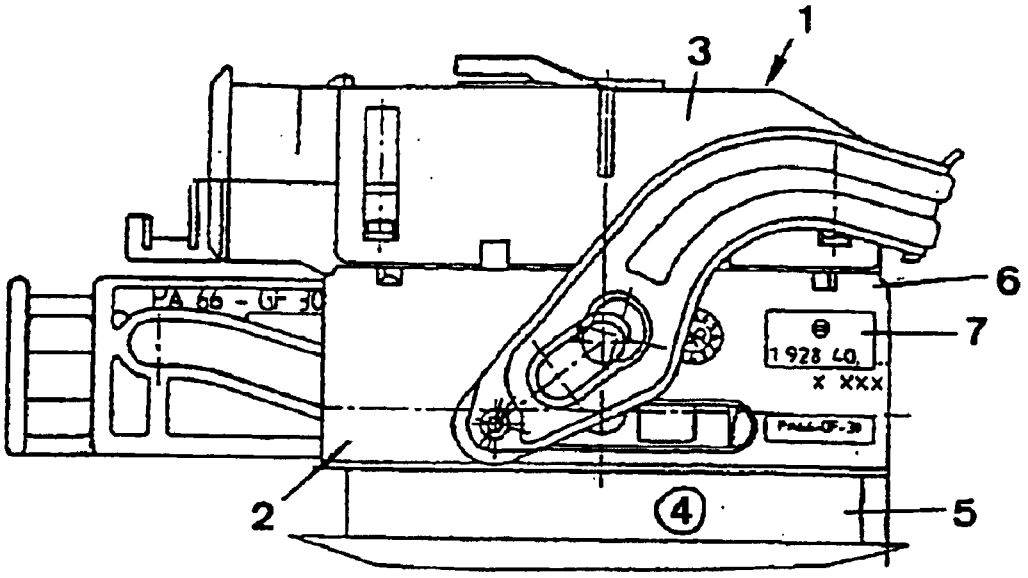
Fig.

ELECTRICAL PLUG CONNECTION HAVING AN ADJUSTABLE CODING

FIELD OF THE INVENTION

The present invention relates to an electrical plug connection including a plug and a mating connector able to be coupled with the plug, at least one region being provided on the outside of the plug for attaching a coding as a function of the connecting of the cable harness to the contact elements situated in the plug, as well as to a method for creating a coding of an assembled plug for producing an electrical plug connection.

BACKGROUND INFORMATION

Codings for plug connections are widely known.

In particular, cable harness plugs have coding regions injection-molded securely onto their outward facing side surfaces or their end faces. These coding regions are used to identify which type of plug part must be used for which cable assembly.

Therefore, for assembling cable, i.e., attaching cable harnesses to a cable harness plug, it is necessary to store different types of cable plugs in order to ensure a certain manufacturing flexibility. However, as a result, it is necessary to stock and manufacture in a cost-intensive manner a large number of types of different designs of cable harness plugs.

SUMMARY OF THE INVENTION

An object of the present invention is to provide a cable harness plug such that the disadvantages of the related art are prevented.

The object is achieved in that the cable harness plug for an electrical plug connection is provided such that an adjustable coding is able to be attached in particular to the side surfaces of the cable harness plug after the plug is completely assembled.

An important advantage of the present invention is that a neutral plug housing for producing an electrical plug connection is able to be created. This neutral plug housing is preferably supplied to a cable manufacturer who then, in contrast with the related art, first attaches a coding of the plug, from which different data are to be taken, after assembly, i.e., after the cable harness is attached to the cable plug and after final inspection.

Advantageously, the attaching is provided in the manner that an additional coding part, e.g. in the form of a plate, is either able to be clipped to the plug or welded or glued onto it.

Furthermore, it is possible for the cable manufacturer to perform appropriate coding by stamping out different plastic elements from a neutral coding region on the part that is securely attached to the plug housing.

Alternatively, it is provided that the appropriate coding is able to be set as a result of the cable manufacturer breaking out pre-stamped parts after the cable is assembled.

This plug of the present invention and this method of the present invention allow reduced stockkeeping of parts, and at the same time, the plug connection is coded and marked by the cable manufacturer in a working step that this plug connection has undergone final inspection. The final inspection first makes it possible for the plug connection to be able to be plugged in on an assembly line of a car manufacturer, for example. In addition, this ensures that cable harnesses or electric plug connections that have not undergone final inspection are not used or installed.

BRIEF DESCRIPTION OF THE DRAWINGS

The FIGURE shows a side view of an electrical plug connection, in particular of a cable harness plug.

DETAILED DESCRIPTION

As shown in the FIGURE, cable harness plug 1 has a plug housing 2 and a cover 3. On its side 4 facing away from cover 3, an opening is provided that is designed such that it is able to accommodate a mating connector 5, which is not shown in greater detail. Provided on plug housing 2 is also a region 6, which uses codings to show the types of cable harness plug 1 as well as its assembly (contacting the individual cable with the contact elements situated in plug housing 2).

In accordance with the present invention, region 6 is provided for attaching a coding in the form of clipping on an identifier 7 immediately after cable harness plug 1 is assembled.

Alternatively, it may also be provided to weld on identifier 7, as represented, for example, in the Figure by reference numeral 7, or also to separate or break out pre-stamped regions as is not shown in greater detail.

Modifying the method for manufacturing and assembling a cable harness plug 1 for an electrical plug connection as well as creating such a cable harness plug 1 have rendered it possible to significantly reduce the number of types necessary to ensure different assemblies of plugs 1. As a result, it is possible to cost-effectively and diversely manufacture cable harness plugs 1 for electrical plug connections.

What is claimed is:

1. An electrical plug connection comprising:

a plug, having contact elements situated therein and including at least one pre-tamped region configured to be broken out to provide a coding as a function of a connecting of a cable harness to the contact; and a mating connector adapted to be coupled with the plug.

2. An electrical plug connection, comprising:

a plug having contact elements situated therein;

a mating connector adapted to be coupled with the plug; and a coding formed by breaking out at least one pre-stamped region in the plug after the plug is completely assembled and a cable harness is connected to the contact elements, the coding providing information for the connecting of the cable harness to the contact elements.

* * * * *

UNITED STATES PATENT AND TRADEMARK OFFICE

CERTIFICATE OF CORRECTION

PATENT NO. : 6,746,271 B2
DATED : June 8, 2004
INVENTOR(S) : Andreas Simmel

It is certified that error appears in the above-identified patent and that said Letters Patent is hereby corrected as shown below:

Column 2,
Line 45, change “one-pre-tamped region” to -- one pre-stamped region --

Signed and Sealed this

Twenty-fourth Day of May, 2005

JON W. DUDAS
*Director of the United States Patent and Trademark Office*